US006012393A

United States Patent [19]

Tal

[11] Patent Number: 6,012,393

[45] Date of Patent: Jan. 11, 2000

[54] ASYMMETRIC PENETRATION WARHEAD

[75] Inventor: Zeev Tal, Haifa, Israel

[73] Assignee: State of Israel-Ministry of Defense, Rafael-Armamient Dieve, Haifa, Israel

[21] Appl. No.: 08/982,899

[22] Filed: Dec. 2, 1997

Related U.S. Application Data

[63] Continuation-in-part of application No. 08/698,538, Aug. 15, 1996, abandoned.

[30] Foreign Application Priority Data

Aug. 17, 1995 [IL] Israel ..... 114973

[51] Int. Cl.[7] ..... F42B 15/10; F42B 10/00

[52] U.S. Cl. ..... 102/374; 102/382; 102/398; 102/473; 102/501; 102/517

[58] Field of Search ..... 102/374, 382, 102/384, 390, 391, 398, 399, 436, 439, 473, 501, 514–519; 244/3.1

[56] References Cited

U.S. PATENT DOCUMENTS

| | | | |
|---|---|---|---|
| 603,466 | 5/1898 | Hammer | 102/399 |
| 740,849 | 10/1903 | Groff | 102/518 |
| 927,852 | 7/1909 | Grunwald | 102/517 |
| 2,464,834 | 3/1949 | Taylor | 102/391 |
| 2,612,108 | 9/1952 | Schmidt | 102/501 |
| 3,282,214 | 11/1966 | Briscoe | 102/517 |
| 3,401,637 | 9/1968 | Briscoe | 102/501 |
| 3,731,630 | 5/1973 | Muller | 102/517 |
| 3,869,101 | 3/1975 | Schnabele et al. | 244/3.1 |
| 3,897,730 | 8/1975 | Riparbelli | 102/517 |
| 3,935,817 | 2/1976 | Riparbelli | 102/517 |
| 3,949,677 | 4/1976 | Voss | 102/501 |
| 4,085,678 | 4/1978 | Heincker | 102/517 |
| 4,090,446 | 5/1978 | Tomasetti | 102/517 |
| 4,228,973 | 10/1980 | Klein | 244/3.1 |
| 4,389,028 | 6/1983 | Kalivretenos et al. | 244/3.1 |
| 4,554,871 | 11/1985 | Nixon | 102/489 |
| 4,637,313 | 1/1987 | Henderson et al. | 102/382 |
| 4,998,994 | 3/1991 | Schmidt et al. | 244/3.1 |
| 5,003,885 | 4/1991 | Rudolf et al. | 102/494 |

FOREIGN PATENT DOCUMENTS

| | | | |
|---|---|---|---|
| 530433 | 9/1957 | Belgium | 102/398 |
| 225 8613 | 8/1975 | France . | |
| 2 673 277 | 2/1991 | France | 102/519 |
| 1428 690 | 1/1969 | Germany . | |
| 40 02 355 A1 | 1/1990 | Germany . | |
| 41 42 116 A1 | 12/1991 | Germany . | |
| 539699 | 9/1941 | United Kingdom | 102/384 |
| WO 82/03453 | 3/1982 | WIPO . | |

OTHER PUBLICATIONS

"The Effect of Nose Shape on the Ballistic Performance of 15–lb. 3" AP Solid Shot Against Homogeneous Armor Plate", Report No. 2–43, U.S. Naval Proving Ground, Dahlgren, Va., (1943).

Weihrauch et al, "Experimental Studies on Terminal Ballistics of Kinetic Energy Projectiles", Coference held at the 3rd Int'l Symposium on Ballistics, Mar., 1977, Germany.

Persson, Ake, "A Theoretical and Experimental Study of the Penetration Mechanics of Rigid Projectiles", *FOA Reports*, 11(4) (1977).

Bernard, Rbt. S., "A Projectile Penetration Theory For Layered Targets", U.S. Army Engineers Experiment Station, Vicksburg, Miss.

*Primary Examiner*—Harold J. Tudor
*Attorney, Agent, or Firm*—Mark M. Friedman

[57] ABSTRACT

A penetration warhead of a positively position-controlled roll-stabilized missile. The warhead has a main axis and includes a nose section which is asymmetric with respect to the main axis of the warhead, the asymmetry is selected such that upon impacting a target the forces acting on the nose section create a moment about the warhead's center of gravity which directs the penetration warhead in a direction which is substantially toward the perpendicular, thereby increasing the warhead's penetration depth.

10 Claims, 6 Drawing Sheets

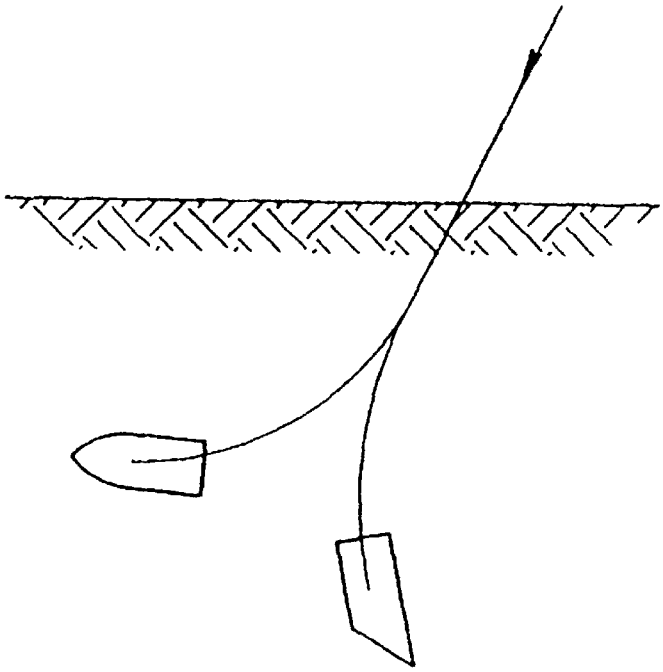
FIG. 10A
FIG.10B
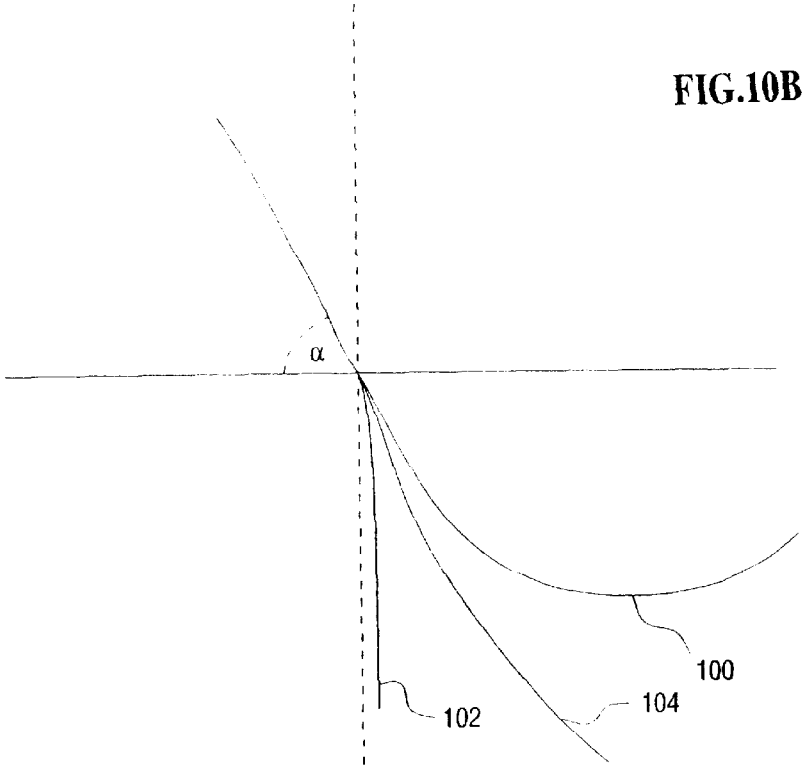

ASYMMETRIC PENETRATION WARHEAD

This is a continuation-in-pail of U.S. patent application No. 08/698,538, filed Aug. 15, 1996 now abandoned.

FIELD AND BACKGROUND OF THE INVENTION

The present invention relates to projectiles and missiles and, more particularly, to positively roll-stabilized guided missiles, "smart bombs" or warhead including remote pilotless vehicles designed to reach and penetrate specific hardened targets.

For ease of presentation, the present invention is described herein in terms of a guided missile, it being understood that the present invention is of far broader applicability.

A typical guided missile is commonly made up of a number of sections, which are housed in, or connected to a generally cylindrical housing of varying radius in the longitudinal direction.

At the front of the missile is the guidance section which typically includes one or more sensors, such as a Forward Looking Infrared (FLIR) or video camera, and the various electronic systems which control the sensors, analyze and interpret the signals received by the sensors, and control the flight control system which positively determines the trajectory and the roll position of the missile. The guidance section may also include means for receiving signals from outside of the missile and may also include means for transmitting signals from the missile.

Behind the guidance section is the warhead which is typically a hollow cylindrically shaped casing, typically made of a high strength steel. The function of a penetration warhead is to penetrate a hardened target and place the explosive charge in the appropriate position, i.e., inside the target, at the moment of explosion, thereby maximizing the effect of the explosion on the target. Inside the hollow casing is placed the explosive and the rear end of the warhead lies the ignition fuse which is designed to be set off at the proper moment, typically, at some predetermined time after the warhead encounters the target. The warhead is typically made of three sections: (1) a front section, or nose, which is usually in the shape of an ogive or cone; (2) the main section which includes the explosive charge and is usually cylindrical; and (3) the aft section which seals the explosive charge within the casing and holds the fuse.

Behind the warhead typically lies the engine which provides thrust to the missile.

Housed in and connected to the housing at the rear of the missile, and in some cases also in other locations along the missile housing, is the flight control section, including fins and foils, which are used to adjust and stabilize the trajectory of the missile during its flight to the target and to prevent the missile from rolling during, flight.

For maximum penetration of the hardened target(et it is desirable to have the missile impact the target directly, i.e., at a 90° to the target surface. In most cases, however, the angle of impact is different, sometimes significantly, from the optimal 90°.

For example, a significant fraction of hardened targets, such as command bunkers, and the like, are built into the ground and have an outer wall which is substantially horizontal. A typical guided missile would typically impact the outer wall at an angle which, in many cases, may be in the range of from about 45° to about 65°, substantially different from the optimal angle of 90°. The deviation of the impact from the perpendicular greatly reduces the penetration depth of the warhead into the target and significantly decreases the effectiveness of the explosion.

There is thus a widely recognized need for, and it would be highly advantageous to have, a warhead which is configured so as to improve its penetration when impacting the target at an angle which deviates from the perpendicular.

SUMMARY OF THE INVENTION

According to the present invention there is provided a penetration warhead for use in a positively position-controlled roll-stabilized missile, the warhead having a main axis, the warhead comprising a nose section which is asymmetric with respect to the main axis of the warhead.

Also according to the present invention, there is provided a roll-stabilized position-controlled missile, comprising a warhead having a nose section, the warhead being characterized in that the nose section is asymmetric with respect to the axis of the warhead.

According to further features in preferred embodiments of the invention described below, the nose section includes a portion which projects forward such that during impact of the missile with a target, the portion of the nose is the first to make contact with the target.

The present invention successfully addresses the shortcomings of the presently known configurations by providing a penetration warhead or projectile which is shaped to include a nose section which is asymmetric with respect to its longitudinal axis. The warhead is intended for use in a positively roll-stabilized, position-controlled, guided missile or projectile designed to penetrate a hardened concrete target or other highly resistant targets. Roll-stabilization relates to the keeping of the angular position of the missile about its axis roughly constant. Position control relates to ensuring that the missile is oriented so that the top portion is pointing up while the bottom portion is pointing down, i.e., to prevent the missile from flying with the wrong roll angle.

BRIEF DESCRIPTION OF THE DRAWINGS

The invention is herein described, by way of example only, with reference to the accompanying drawings, wherein:

FIG. 10A shows a comparison between the paths taken by a conventional warhead and a warhead according to the present invention following impact with a target at an angle;

FIG. 10B shows a comparison among the paths taken by a bomb as disclosed in GB 539699, a warhead according to the present invention and a conventional warhead following impact with a target at an angle;

DESCRIPTION OF THE PREFERRED EMBODIMENTS

The present invention is of a penetration warhead assembled in a roll-stabilized or non-rolling guided missile, smart bomb or warhead including remote pilotless vehicle (herein referred to collectively or singularly as "missile") body having a construction which significantly improves the penetration of the warhead into a target which is impacted at an angle which differs from the perpendicular.

Figure 1:
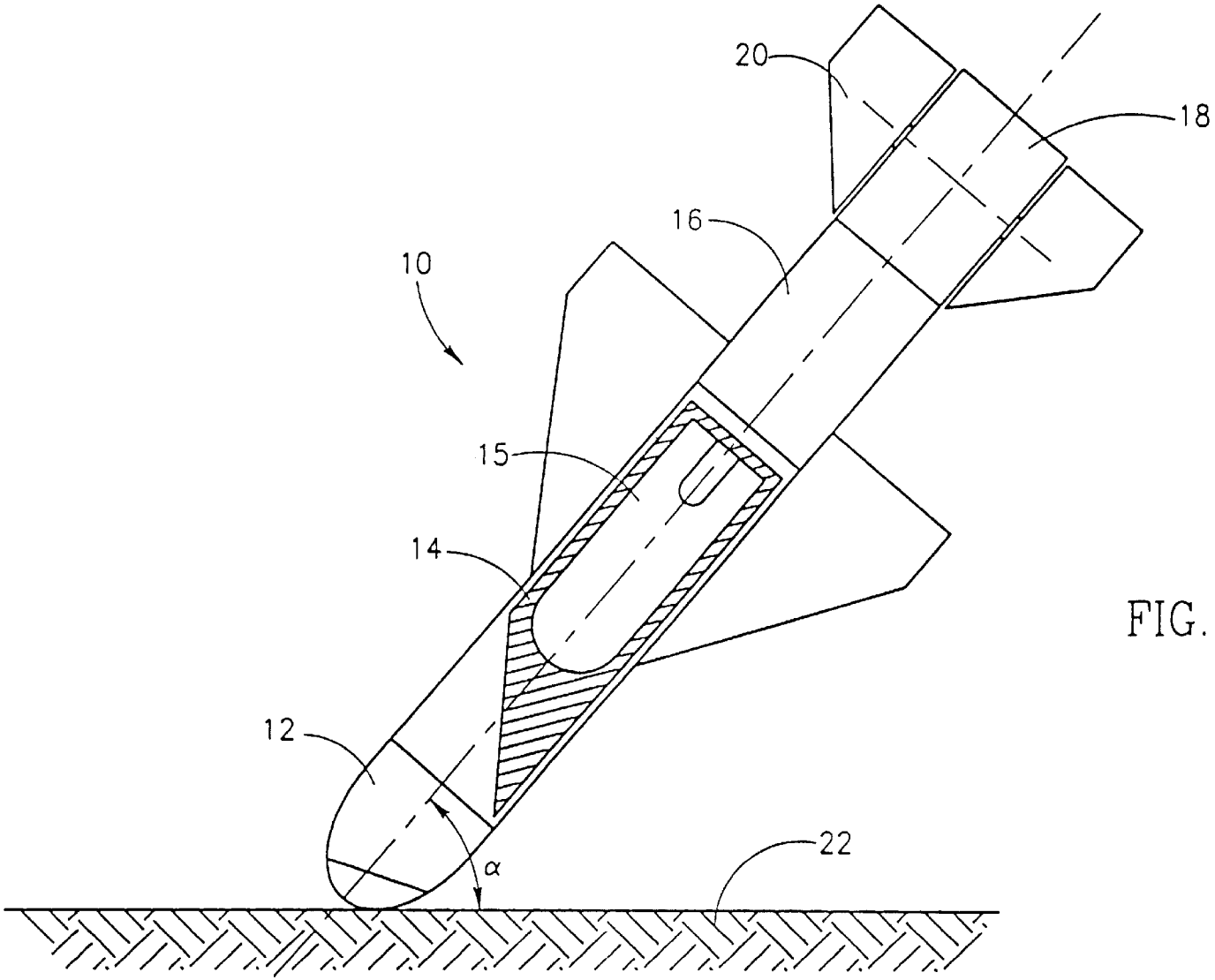
FIG. 1 shows an illustrative guided missile according to the present invention as it appears just prior to impact with a target.

The principles and operation of a warhead or missile according to the present invention may be better understood with reference to the drawings and the accompanying description. Shown in FIG. 1, is a schematic side cross-sectional view of a missile 10 which includes a guidance section 12, a warhead 14 (which is described in greater detail below), with an explosive charge 15, an engine section 16 and a flight control section 18 and tail fins 20. Missile 10 is shown just prior to impact with a target 22, at a certain angle, $\alpha$, between the plane of the target and the main (longitudinal) axis of missile 10.

Presently, various warheads, bombs and projectiles are used for penetrating armored vehicles, such as tanks and thick concrete or similar other hard or hardened targets, typically made of concrete and further protected by layers of rock, soil and/or steel.

Presently available warheads are symmetrical so that the performance of the missile is independent of its roll angle at the moment of impact between the missile and the target. The symmetry of the warhead is critical in missiles, bombs, and the like, which roll during flight so that it is not possible to predict the roll angle of the missile at the instant of impact.

Figure 2:
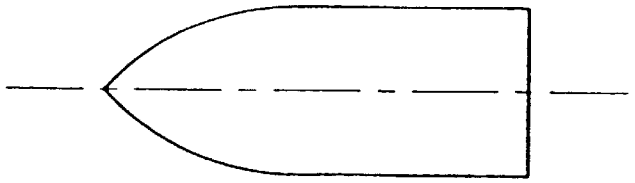
FIG. 2 shows a warhead with a ogival nose.
Figure 3:
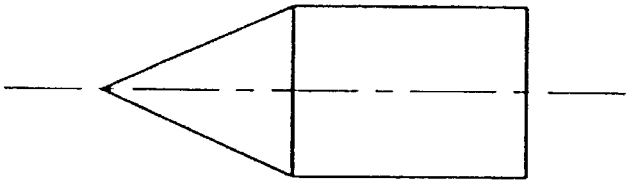
FIG. 3 shows a warhead with an conical nose.

Typically, the nose of a conventional warhead has either an ogival or a conical front section (FIGS. 2 and 3, respectively), both configurations being completely symmetrical with respect to the main axis of the warhead.

The purpose of a penetration warhead is to penetrate as deeply as possible into the target in order to place the explosives in the targeted space, or as close to it as possible. The extent of penetration of the warhead is greatly affected by the angle of impact, i.e., the angle between the main axis of the missile or warhead and the plane of the target.

Figure 4:
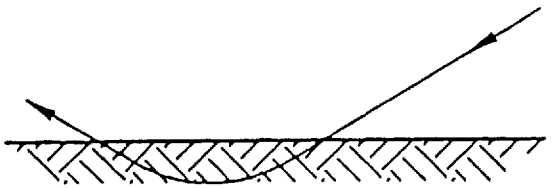
FIG. 4 indicates the path of a projectile impacting a target at a very low angle resulting in a ricochet.

Most warheads strike their target at angles which are substantially in the range of from about 45° to about 65°. At sufficiently small angles there is a greater chance of a ricochet, i.e., the warhead is likely to fail to penetrate the target and to bounce off the target (FIG. 4).

Figure 5:
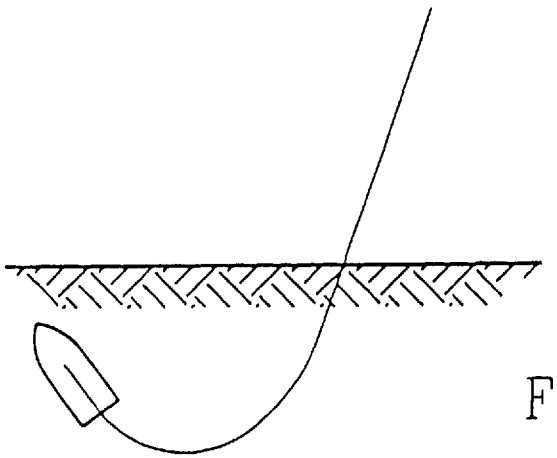
FIG. 5 indicates the path of a projectile impacting a target at a larger angle than in FIG. 4 resulting in a J-shaped trajectory.

At an impact angle of greater than about 45°, the warhead penetrates the target but tends to form a J-shaped path (FIG. 5). The diversion of the warhead from a straight line path is causes by an imbalance of forces on the nose of the warhead, as shown schematically in FIG. 8 which induces a moment, M, tending to rotate the warhead about its center of gravity in a direction away from the target. In some cases the warhead comes to a stop with its nose pointing somewhat away from the target. The J-shaped path implies a decreased penetration of the warhead into the target.

Figure 6:
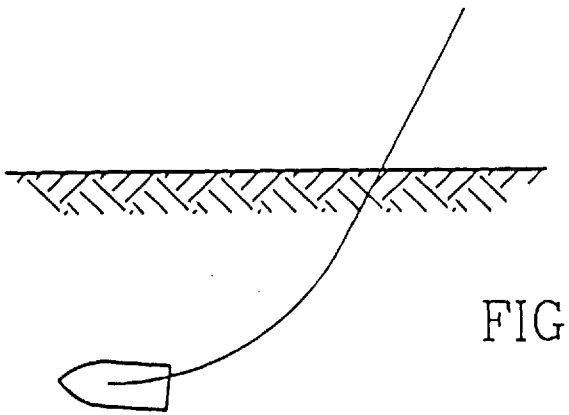
FIG. 6 indicates the path of a projectile impacting a target at a larger angle than in FIG. 5 resulting in an attenuated J-shaped trajectory.

At somewhat larger impact angles, milder J-shaped paths are encountered (FIG. 6).

Figure 7:
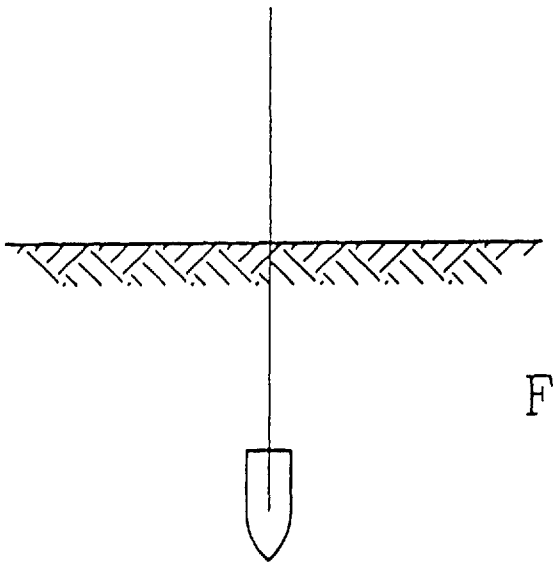
FIG. 7 indicates the path of a projectile impacting a target at a 90° angle.

Finally, when the missile impacts the target perpendicularly, i.e., at 90°, the warhead moves directly into the target and maximum penetration depth is achieved (FIG. 7). In some cases the differences in penetration achieved with a head-on impact (FIG. 7) and angled impacts (FIGS. 5 and 6) could mean the difference between delivery of the explosive charges directly into, or in close proximity to, the intended area, with a resultant highly effective explosion, and allowing the explosives to detonate in a location where little or no real damage is done to the intended target.

The present invention relates to a kinetic energy penetrating warhead which is designed to at least partly mitigate the negative effects of an angled impact of a hardened target.

A warhead according to the present invention includes, in sharp contrast with known warheads, a front section, or nose, which is asymmetric with respect to the main axis of the warhead, the asymmetry is selected such that the forces acting on the nose of the warhead tend to create a moment about the warhead's center of gravity which tends to direct the penetrating warhead in a direction which is substantially toward the perpendicular, thereby increasing the warhead's penetration depth.

A warhead according to the present invention is intended for use with guided missiles, projectile or smart bombs which do not roll, or are roll-stabilized, position-controlled and which are designed to penetrate hard and high value targets. In such systems, the missile or bomb has defined up and down portions and impact takes place substantially with the lower portion of the system.

Figure 8:
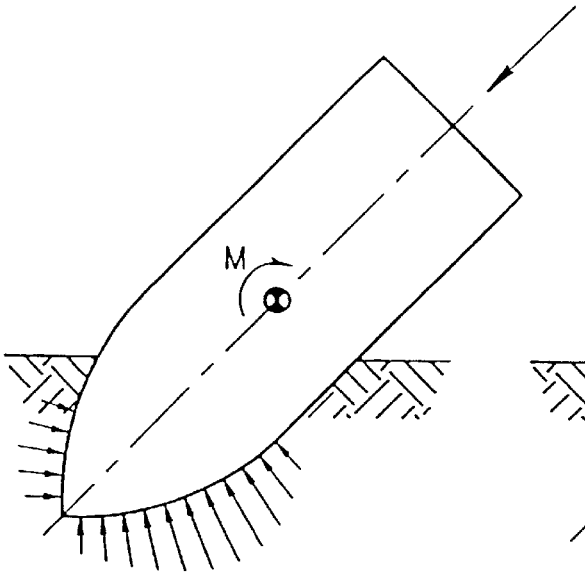
FIG. 8 schematically depicts the forces experienced by a conventional warhead upon impact.
Figure 9:
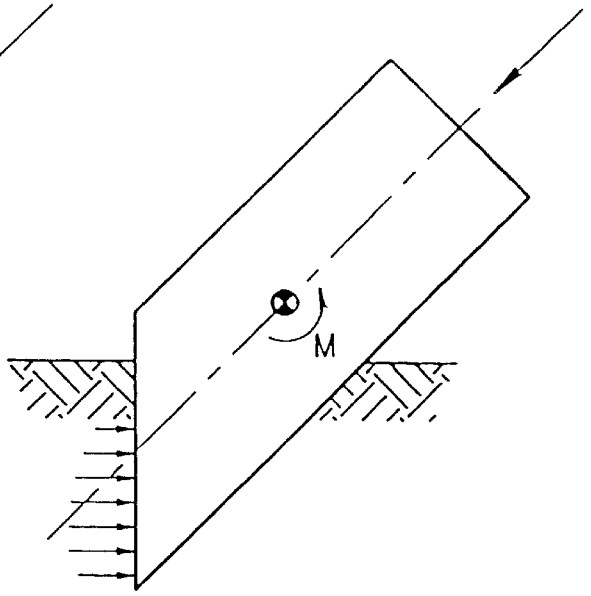
FIG. 9 schematically depicts the forces experienced by a warhead according to the present invention upon impact.

As is shown schematically in FIG. 9, the asymmetric configuration of the warhead makes it possible for the warhead to dig into the target by allowing the target counter forces to act on the warhead so as to counter and correct the tendency of the warhead to take a J-shaped path, as shown in FIGS. 8, 5 and 6. The forces acting on the nose of the warhead thus tend to create a moment, M, about the warhead's center of gravity which tends to direct the penetrating warhead in a direction which is substantially toward the perpendicular, thereby increasing the warhead's penetration depth.

The difference in path taken by two warheads, one symmetrical and the other asymmetrical as described, is illustrated schematically in FIG. 10A. As can be seen, the symmetrical warhead is diverted from its intended direction while the path of an asymmetric warhead according to the present invention is actually corrected so as to approach the perpendicular. The resultant deeper penetration, and resultant enhanced explosion effectiveness, can be seen in FIG. 10A.

Asymmetry of various projectiles has been a subject of interest for a long time. U.S. Pat. No. 603,466 to Hammer discloses projectiles with an asymmetric nose section and flanges to control the traveling direction of the projectiles (i.e., before impacting, a target). The projectiles described by Hammer are not positively roll stabilized and/or position controlled. WO 82/03453 (PCT/AU82/00044) to Thomson disclose a missile having a directional control device which affects the symmetry of its nose section during traveling (i.e., again, before impacting a target). Thus, both Hammer and Thomson disclose projectiles having an oblique conical configuration at their anterior end, which configuration affects their aerodynamic progress or flight through air (or hydrodynamic progress through water), however, these configurations do not affect their penetration capabilities into a target in a manner that will create a moment about the center of gravity which directs the projectile in a direction which is substantially toward the perpendicular during penetration. In other words, these patents provide designs for controlling a projectile during its flight to the target, which designs are not at all applicable for controlling the projectile's behavior after impact (i.e., during penetration).

Furthermore, the Hammer patent was published at 1898. Therefore, Hammer could not have possibly describe an active roll-stabilized position-controlled missile, since such projectiles were developed about 40 years later. The first positively roll-stabilized position controlled missile was introduced by the Germans during WW2. These missiles are known as V1 and V2.

In fact, Hammer describes a bullet which is fired from a firearm. There is a sharp distinction between a bullet and warhead of a missile, which, as opposed to a bullet, includes explosives. Webster's dictionary defines a warhead as the forward section of a missile, bomb, torpedo, or the like, containing the explosive or payload.

Further concerning the invention by Thomson, please note that the present invention is not directed toward a missile having an oblique conical configuration at its anterior end. Flight or path control according to the missile of the present invention is effected via, for example, tail fms 20 (see FIG. 1).

Other projectiles having asymmetric nose sections are disclosed in U.S. Pat. No. 4,998,994 to Schmidt et la., U.S. Pat. No. 4,389,028 to Kalivietenos et al., U.S. Pat. No. 3,869,101 to Schnabele et al., U.S. Pat. No. 3,282,214 and U.S. Pat. No. 3,401,637 to Briscoe, and U.S. Pat. No. 3,949,677 to Voss, and in FR 2673277A to Roland, U.S. Pat. No. 4,085,678 to Heincker discloses a projectile equipped with a warhead having a forward section and an aft section. The forward section has an asymmetric rear end, whereas the aft section has an asymmetric front end, such that these rear and front ends match one another. The forward section is used to penetrate a target, whereas the aft section includes the explosives and is intended to follow the forward section into the target.

Thus, the warhead taught by Heincker does not have a nose section which is asymmetric with respect to the main axis of the warhead. In other words, the nose section of the warhead taught by Heincker is symmetric.

This is clearly evident fiom the Figures accompanying Heincker's disclosure.

Therefore, such a warhead would suffer all the limitations of a conventional symmetric warhead, which limitations are solved by a nose section which is asymmetric with respect to the main axis of the warhead.

Thus, Heincker teaches an aft section of a warhead which has an asymmetric front, however, that front is not intended for penetrating the target, as specifically explained on column 3, lines 41–53, of the Heincker patent. On the contrary, as therein specifically explained, it is the front of the forward section of the warhead which is intended to penetrate the target, wherein the aft section merely follows the forward section, which is symmetric.

In addition Heincker's missile is not a positively position-controlled roll-stabilized missile, and therefore the roll position of the Heincker's missile upon impact is a matter of statistics.

GB 539699 to Kent discloses an aerial bomb with a nose section equipped with a detachable part, such that, upon impacting a water body, the detachable part disintegrates and renders the nose section asymmetric. The asymmetry in this case is selected such that following impact (i.e., in water) the forces acting on the nose section tend to create a moment about the warhead's center of gravity which tends to direct the penetrating warhead in a direction which is substantially toward the horizontal (see FIG. 8 therein).

A distinctive difference in the constructions and therefore the behavior following impact of the bomb described by Kent, the warhead according to the present invention and a conventional symmetric warhead is emphasized in FIG. 10B.

Considering an impact angle $\alpha$ (e.g.,., 45–65°) in a horizontal target, the bomb of Kent, as indicated by 100, progresses in a path which becomes closer to the horizontal, whereas the warhead according to the present invention, as indicated by 102, progresses in a path which becomes closer to the vertical. In other words, the bomb of Kent progresses away from the perpendicular, whereas the warhead according to the present invention progresses closer to the perpendicular. A symmetric warhead, as indicated by 104, would take an intermediate path (see also FIG. 10A).

Various and sundry asymmetric nose sections may be envisioned. All of these are intended to be included within the scope of the present invention. Illustrative of some of the various possibilities are the configurations shown in FIGS. 11 to 22. The precise choice of nose design and degree of asymmetry will depend on the parameters of intended applications, perhaps including, but not limited to, the expected nature of the target, the type of explosives used and the expected angle of impact.

Figure 12:
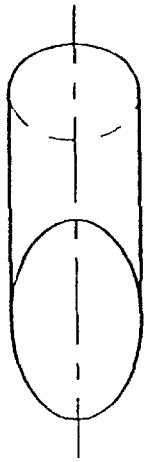
FIG. 12 is a front view of the nose of FIG. 11.
Figure 11:
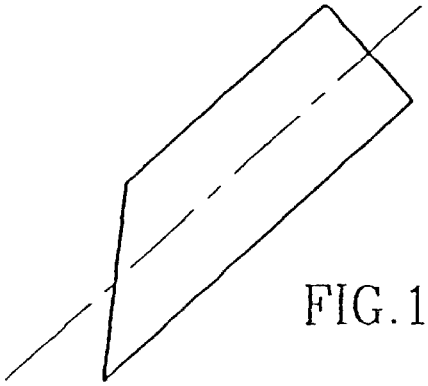
FIG. 11 shows a side view of one possible nose design of a warhead according to the present invention.

Shown in FIGS. 11 and 12 are a side and a front view of a nose design which includes a planar surface. The planar surface takes on the shape of an ellipse.

Figure 14:
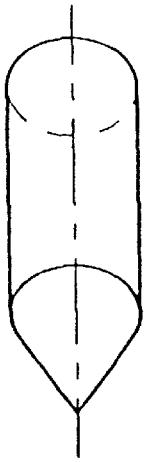
FIG. 14 is a front view of the nose of FIG. 13.
Figure 13:
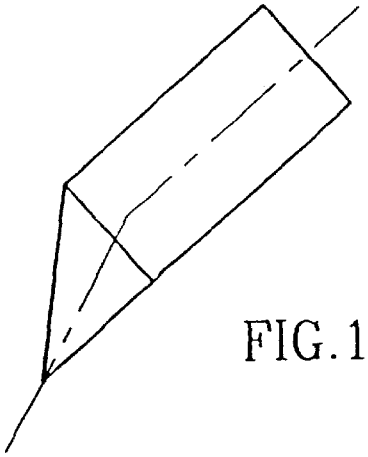
FIG. 13 shows a side view of a second possible nose design of a warhead according to the present invention.

Another possible configuration is shown in FIGS. 13 and 14. Here, the nose section is in the shape of an oblique cone, i.e., a cone which is asymmetric with respect to its base or, more importantly with respect to the main axis of the warhead whereas the cone tip can be at any designed distance from the warhead main axis.

Figure 16:
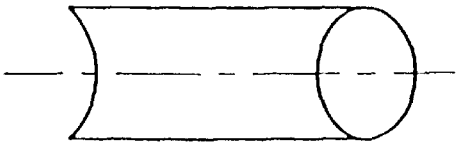
FIG. 16 is a top view of the nose of FIG. 15.
Figure 15:
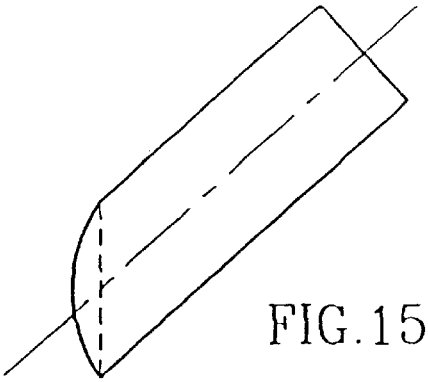
FIG. 15 shows a third possible nose design of a warhead according to the present invention.
Figure 18:
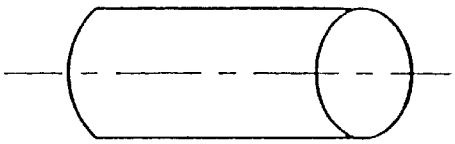
FIG. 18 is a top view of the nose of FIG. 17.
Figure 17:
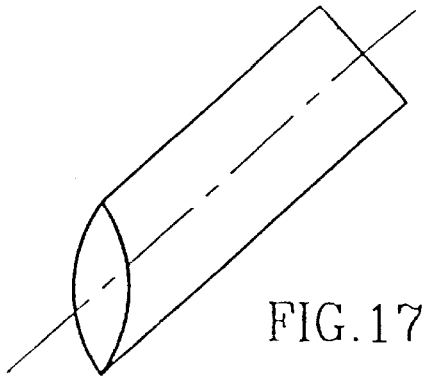
FIG. 17 shows a side view of a fourth possible nose design of a warhead according to the present invention.
Figure 20:
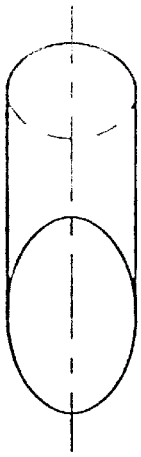
FIG. 20 is a front view of the nose of FIG. 19.
Figure 19:
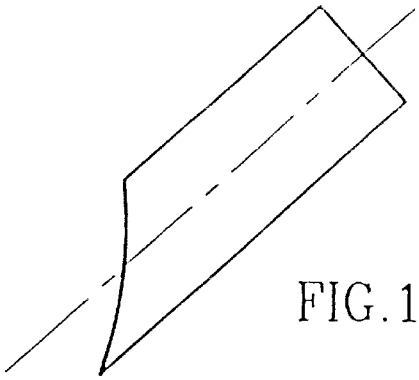
FIG. 19 shows a side view of a fifth possible nose design of a warhead according to the present invention.
Figure 22:
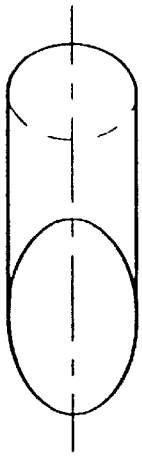
FIG. 22 is a front view of the nose of FIG. 21.
Figure 21:
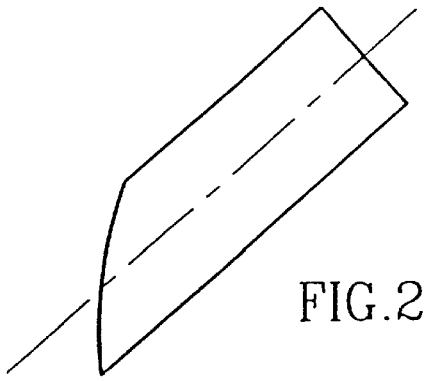
FIG. 21 shows a side view of a sixth possible nose design of a warhead according to the present invention.

Shown in FIGS. 15 and 16 is a nose section which is asymmetrically concave while the nose section in the embodiments of FIGS. 17 and 18 are asymmetrically convex. Finally, shown in FIGS. 19 and 20 and in FIGS. 21 and 22 are two more configurations which are asymmetrically concave and convex.

While the invention has been described with respect to a limited number of embodiments, it will be appreciated that many variations, modifications and other applications of the invention may be made.

What is claimed is:

1. A penetration warhead of a positively position-controlled roll-stabilized missile, the warhead having a main axis, the warhead comprising a nose section which is rigidly asymmetric with respect to said main axis of the warhead, said asymmetry is selected such that upon impacting and penetrating a target at an angle which deviates from a perpendicular to a surface of said target, the forces acting by said target on said nose section create a moment about the warhead's center of gravity which directs the penetration warhead in a direction which is substantially toward the perpendicular, thereby increasing the warhead's penetration depth into the target.

2. The warhead of claim 1, wherein said nose section includes a planar configuration at its anterior end.

3. The warhead of claim 1, wherein said nose section includes an oblique conical configuration at its anterior end.

4. The warhead of claim 1, wherein said nose section includes a convex configuration at its anterior end.

5. The warhead of claim 1, wherein said nose section includes a concave configuration at its anterior end.

6. A positively roll-stabilized position-controlled missile, comprising a generally cylindrical housing and a flight control system being implemented within and on said housing, said flight control system being for determining the trajectory and the roll position of the missile, said housing including:

(a) a guidance section being implemented on said housing for controlling said flight control system; and (b) a penetration warhead having a main axis and a nose section, said warhead being characterized in that said nose section is rigidly asymmetric with respect to said axis of the warhead, said asymmetry is selected such that upon impacting and penetrating a target at an angle which deviates from a perpendicular to a surface of said target, the forces acting by said target on said nose section create a moment about the warhead's center of gravity which directs the penetration warhead in a direction which is substantially toward the perpendicular, thereby increasing the warhead's penetration depth into the target.

7. The missile of claim 6, wherein said nose section includes a planar configuration at its anterior end.

8. The missile of claim 6, wherein said nose section includes an oblique conical configuration at its anterior end.

9. The missile of claim 6, wherein said nose section includes a convex configuration at its anterior end.

10. The missile of claim 6, wherein said nose section includes a concave configuration at its anterior end.

* * * * *